United States Patent [19]

Helszajn

[11] 4,016,509

[45] Apr. 5, 1977

[54] WAVEGUIDE CIRCULATORS

[75] Inventor: Joseph Helszajn, Edinburgh, Scotland

[73] Assignee: National Research Development Corporation, London, England

[22] Filed: Oct. 31, 1975

[21] Appl. No.: 627,786

[30] Foreign Application Priority Data

Nov. 6, 1974 United Kingdom ..... 48031/74

[52] U.S. Cl. ..... 333/1.1; 333/98 R

[51] Int. Cl.[2] ..... H01P 1/38

[58] Field of Search ..... 333/1.1

[56] References Cited

UNITED STATES PATENTS

| | | | |
|---|---|---|---|
| 3,246,262 | 4/1966 | Wichert | 333/1.1 |
| 3,350,664 | 10/1967 | Pistilli et al. | 333/1.1 |
| 3,714,608 | 1/1973 | Barnes et al. | 333/1.1 |
| 3,851,279 | 11/1974 | Andrikian | 333/1.1 |

OTHER PUBLICATIONS

Davis et al, E–Plane 3–Port X–Band Waveguide Circulators, IEEE Trans. on MTT, Sept. 1963, pp. 443–445.

DeCamp, Jr. et al, 1–MW Four–Port E–Plane Junction Circulator, IEEE Trans. on MTT, Jan. 1971, pp. 100–103.

*Primary Examiner*—Paul L. Gensler

*Attorney, Agent, or Firm*—Cushman, Darby & Cushman

[57] ABSTRACT

Three-port partial height microwave circulators are described in various forms in which the ferrite element is partially replaced by dielectric material with a view to reducing heat dissipation and upgrading power handling capabilities.

16 Claims, 8 Drawing Figures

WAVEGUIDE CIRCULATORS

Figure 1:
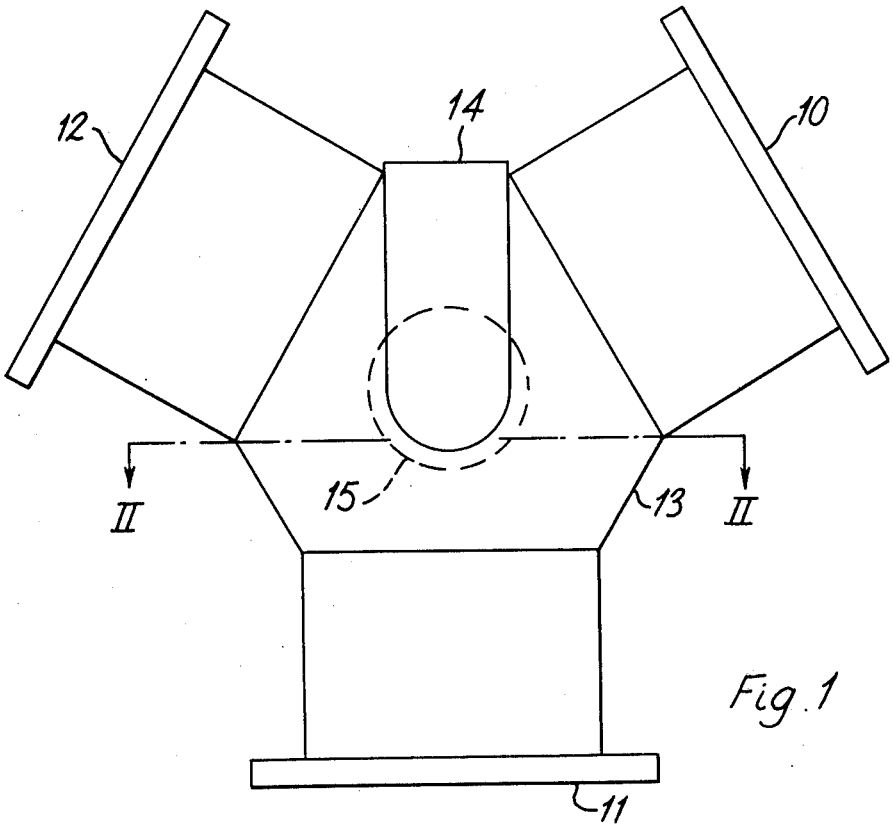

The present invention relates to three-port high-power waveguide junction circulators.

In this specification a microwave junction circulator of the type specified is defined as including a junction member having first, second and third ports each suitable for coupling to a resonant waveguide, at least one gyromagnetic element, usually of ferrite material, positioned in the junction member, and means for applying a magnetic field to the gyromagnetic element, the circulator being such that, in operation, microwave energy in a predetermined frequency range applied at the first, second and third ports emerges with relatively little attenuation at the second, third and first ports, respectively but emerges with relatively greater attenuation at the third, first and second ports, respectively. Three port circulators of the type specified are well known have been described in many papers.

The average power rating of such circulators is limited by the maximum permitted temperature rise. Since the saturation magnetisation of ferrite materials vanishes at its curie temperature one effect of temperature is to reduce the magnetisation with consequent detuning of the circulator. Although temperature compensated ferrite materials are available they normally have undesirably larger magnetic losses than uncompensated materials.

The two factors controlling the temperature rise in the junction are the microwave losses and the thermal resistance of the junction. The total power loss normally includes the electric losses and the linear and non-linear magnetic losses of the ferrite material, and conventional transmission losses. The heat sinking of the ferrite material often takes the form of forced air cooling or water cooling. However, a shortcoming of ferrite materials is that they have relatively poor thermal conductivities compared with some other materials. For instance, the thermal conductivity of WESCO AL-995 ceramic is $70 \times 10^{-3}$ cal $cm^{-1}S^{-1}c$ and that of Beryllia oxide is $525 \times 10^{-3}$ cal $cm^{-1}S^{-1}c$. For ferrites it is $5 \times 10^{-3}$ cal $cm^{-1}S^{-1}c$. The final configuration and ferrite material used is usually a compromise between temperature stability of the saturation magnetisation and linear and non-linear losses associated with the average and peak power of the device.

According to a first aspect of the present invention there is provided a microwave junction circulator of the type specified which includes a number of dielectric elements one for and associated with the gyromagnetic element or each gyromagnetic element where more than one is provided, the centre of the said frequency range depending partly on the dimensions and dielectric properties of the gyromagnetic and dielectric elements, the extent of the said frequency range depending partly on the dimensions and magnetic properties of the gyromagnetic element or elements and the magnetic field applied in operation, the dielectric element, or each dielectric where more than one is provided, being aligned in the direction of the magnetic field with the associated gyromagnetic element, the, or each gyromagnetic element and its associated dielectric element together having an overall axial length substantially equal to an odd number (including one) of quarters of a wavelength at the centre frequency of the said range, and one end but not the other end of the or each gyromagnetic element being in electrical contact with a wall of the junction member.

According to a second aspect of the present invention there is provided a microwave junction circulator of the type specified wherein the or each gyromagnetic element is cylindrical, and the three ports have centres in a plane generally transverse to the axis of the gyromagnetic element or each gyromagnetic element where more than one is provided, with imaginary lines from the point of intersection of the said axis and the said plane to the said centres forming three equal angles in the plane, the circulator including a number of cylindrical dielectrc elements within the junction member one for and associated with the gyromagnetic element or each dielectric element where more than one is provided, the dielectric element having an axis which is the same as that of the associated gyromagnetic element or is an extension thereof, the, or each gyromagnetic element and its associated dielectric element together having an overall axial length substantially equal to one quarter of a wavelength at the centre frequency of the said range, and one end but not the other end of the, or each, gyromagnetic element being in electrical contact with a wall of the junction member.

In this specification the centre of a port means the point where axes of symmetry of the port intersect; cylindrical may refer to solid or hollow cylinders; and cylinders having the same axis that is coaxial may overlap, or be adjacent or be separated from one another. Aligned means not only where elements are aligned end to end but also, where one element wholly or partly contains the other, that the alignment of the internal element and the external element are the same. Further, where the axial length of a gyromagnetic element together with an associated dielectric element is defined in this specification in terms of a quarter of a wavelength, the wavelength concerned is for propagation in the materials of the element. Thus each such quarter wavelength is made up of a portion having an equivalent length dependent on the material and dimensions of the gyromagnetic element and a portion having an equivalent length dependent on the material and dimensions of the dielectric element.

A circulator according to the first or second aspects of the invention falls into the class known as 'partial height' circulators since the gyromagnetic element, or each such element where more than one is provided, together with its associated dielectric element does not extend completely across the junction member from wall to wall.

Waveguide junction circulators must satisfy two conditions: firstly a resonance condition which determines the centre frequency of the band which can be handled, and secondly the gyrator impedance of the junction which determines the separation of split frequencies marking the limits of the band. The first condition depends in known circulators on the dielectric constant and dimensions of the gyromagnetic element. The invention stems from the realisation that since other materials with suitable dielectric properties but higher thermal conductivity are available these materials can be used to replace part of the ferrite if the second condition is still satisified. In known circulators there is usually considerable more ferrite material than is required to satisfy the second condition, this additional material only being present in order to satisfy the first condition. Thus in the first and second aspects of the invention the dielectric element can be regarded as replacing part of the ferrite element and so not only improving heat transmission in the junction, but also reducing the linear and non-linear magnetic losses of the device. Thus power rating is improved or alternatively, for a given power rating, the size of the circulator may be reduced. If just over two thirds of the ferrite material in a conventional circulator is replaced by dielectric material the average power rating is increased by a factor of nine.

Usually in a circulator according to the invention the junction member includes a "Y" shaped hollow chamber having rectangular ports at the end of the stem and arms of the Y. The gyromagnetic element includes a ferrite disc fixed at the junction of the Y on a wall of the chamber parallel to the plane of the Y and another ferrite disc similarly situated but on the opposite wall.

The dielectric element may then also be disc shaped, having the same diameter as the ferrite member, and be fixed to the outer surface of the ferrite member. A further dielectric element is then provided for the other ferrite member and has the same dimensional relationship and relative position to the other ferrite member.

The resonance condition can then be expressed, when both the dielectric and ferrite discs have the same dielectric constant by the equation:

$$\frac{2\pi L_T \sqrt{\epsilon_d}}{\lambda_o} = \frac{\pi}{2}$$

and the split frequencies can be obtained from:

$$\cot\left[\frac{\pi}{2}\left(\frac{\lambda_o}{\lambda \pm 1}\right)\left(\frac{L_F}{L_T}\right)\sqrt{\mu \mp K}\right] = \sqrt{\mu \mp K}\left[\tan\frac{\pi}{2}\left(\frac{\lambda_o}{\lambda \pm 1}\right)\left(1 - \frac{L_F}{L_T}\right)\right]$$

where $L_F$ = axial length of each ferrite disc $L_D$ = axial length of each dielectric disc $L_T = L_F + L_D$ $\lambda_o$ = wavelength of centre frequency of the circulator $\lambda \pm 1$ = wavelengths of split frequencies of the circulator $\epsilon d$ = relative dielectric constant of dielectric of ferrite and materials $\mu$ = diagonal component of tensor permeability K = off-diagonal component of tensor permeability.

The above equations may be used to calculate the dimensions of the dielectric and ferrite discs. The radius of the discs may be obtained from the $HE_{11}$ mode chart shown in "Common Waveguide Circulator Configurations" by Dr. J. Helszajn in Electronic Engineering, September 1974, Pages 66 to 68. In this chart $k_o = (2\pi/\lambda_o$ and $E_r$ is the dielectric constant.

It will be apparent that the dielectric and gyromagnetic members may take many different forms; for example the dielectric members may have a larger diameter than the ferrite members and have a cavity, in which the ferrite members fit with the result that the dielectric members enclose the ferrite members.

Suitable dielectric materials are thought to include brush beryllium and alumina.

Figure 2:
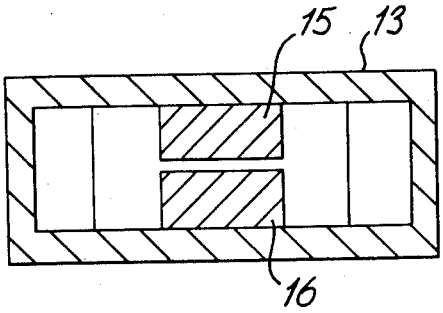
Fig. 2 Prior Art
Figure 3:
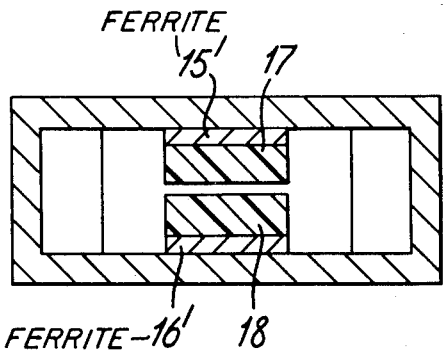
Figure 4:
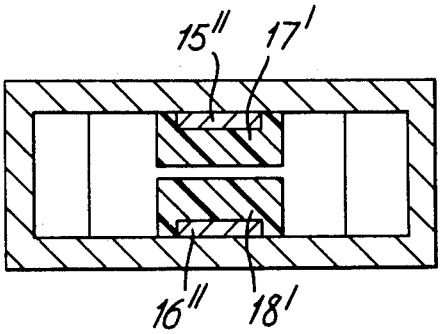
Figure 5:
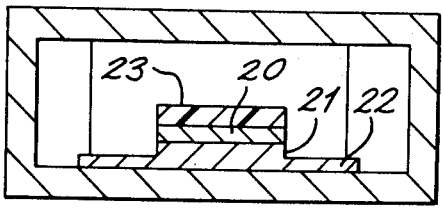

Certain embodiments of the invention will now be described by way of example with reference to the accompanying drawing in which:

FIG. 1 is a plan view of the exterior of a three port circulator of the known type or according to the present invention, FIG. 2 is a cross-section on the line II—II of FIG. 1 for known circulators, FIG. 3 is a cross-section on the line II—II for a first embodiment of a circulator according to the present invention, FIG. 4 is a cross-section on the line II—II for a second embodiment of a circulator according to the present invention, FIG. 5 is a cross-section on the line II—II for a third embodiment of the invention using a single ferrite disc, a pedestal and a transformer.

Figure 8:
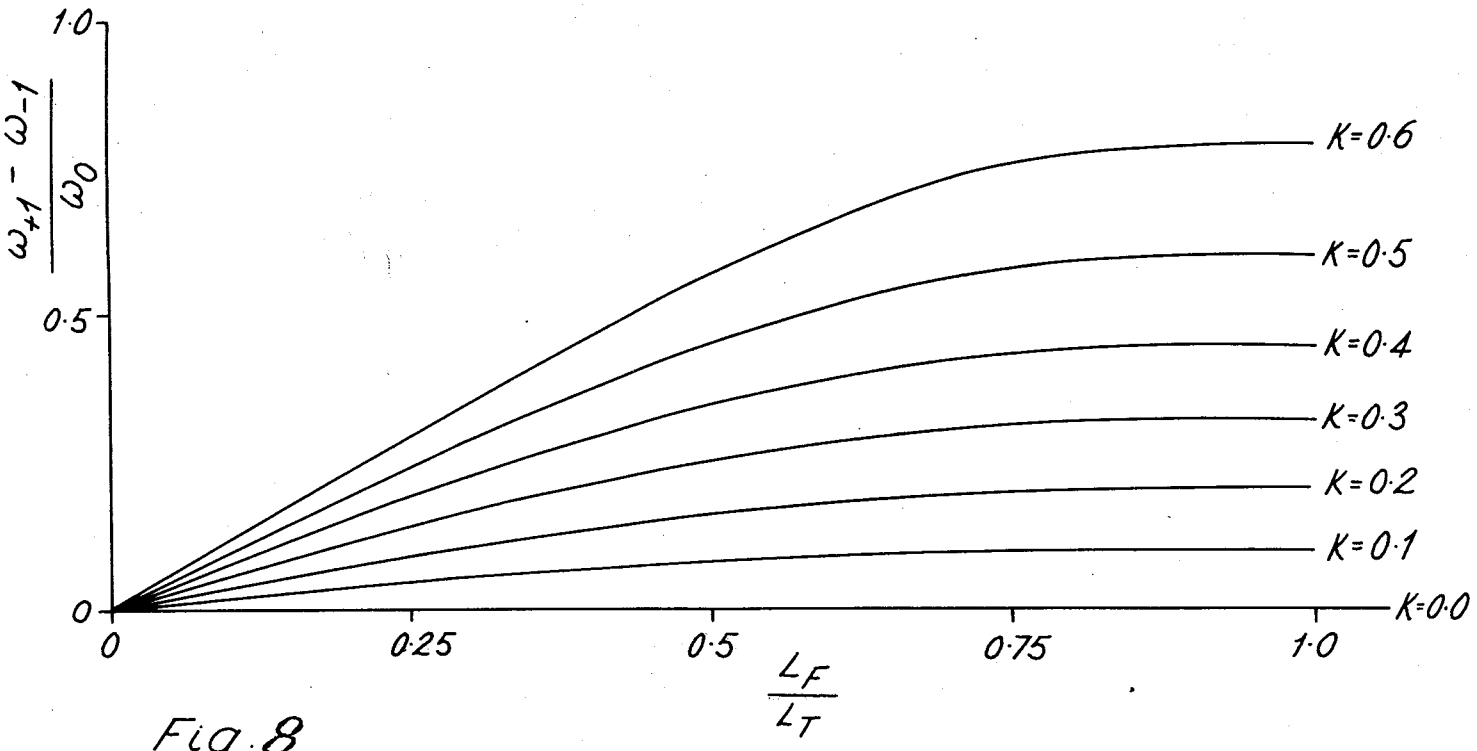
Figure 6:
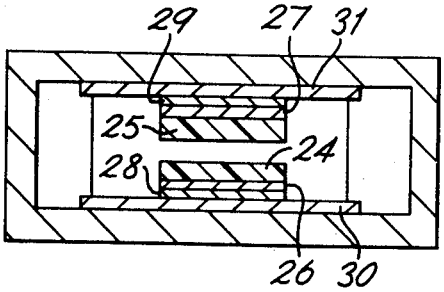
Figure 7:
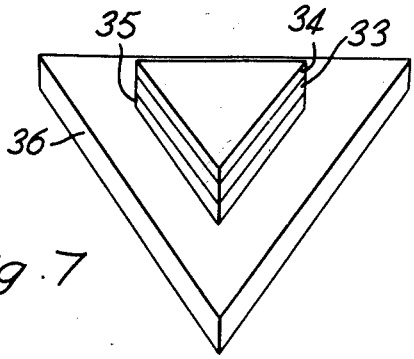

FIG. 6 is a cross-section of the line II—II for a fourth embodiment of the invention using two assemblies of the kind indicated in FIG. 5, FIG. 7 shows a triangular (ferrite, dielectric, pedestal and transformer) assembly for use singly or with another such assembly in the embodiment of FIG. 1 to replace the cylindrical assembly indicated, and FIG. 8 is a graph indicating how replacement of ferrite by dielectric material changes the bandwidth of a circulator.

FIG. 1 a Y shaped junction member 13 has three ports 10, 11 and 12 suitable for coupling to resonant waveguides. A permanent magnet 14 applies a magnetic field to disc shaped ferrite members one of which 15 is shown by a broken line in FIG. 1. This Figure since it shows the exterior of a circulator only, does not show differences between known circulators and circulators according to the present invention.

FIG. 2 is a cross-section of a known circulator in which two ferrite discs 15 and 16 are positioned on the transverse axis of the junction member 13. Since this is a 'partial height' circulator the axial length of each of the members 15 and 16 is a quarter of a wavelength at the centre frequency of the working frequency band of the circulator. As is well known, in operation, the interaction of the permanent magnet and the ferrite members 15 and 16 allow waves to pass from, for example, the port 11 to the port 12 with relatively little attenuation; while waves entering the port 12 are greatly attenuated before they emerge from the port 11. As has been mentioned the amount of ferrite used in known circulators is more than is required to achieve the required directional properties, but the additional ferrite material is needed to give the junction member 13 the required resonant properties.

In FIG. 3 which incorporates the invention, the ferrite discs 15 and 16 have been replaced by composite discs comprising small ferrite disc 15' and 16' and dielectric discs 17 and 18. The two conditions for the resonant circulator are maintained but losses are smaller and heat transfer is more effective. The overall axial length of each pair of discs 15' and 17, and 16' and 18 is a quarter of a wavelength in the material of the discs at the centre frequency of the working band of the circulator and the diameter of each disc is half a wavelength at this frequency.

Typical dimensions for a 9GHz circulator are: axial length of each ferrite disc 0.03 inches, overall axial length of each ferrite and dielectric disc together 0.100 inches, and radius of each disc 0.175 inches.

Another way in which composite discs replacing the ferrite discs may be made is shown in FIG. 4, where the ferrite discs 15'' and 16'' are totally enclosed by dielectric members 17' and 18' having recesses for the ferrite discs. The axial length of each of the members 17' and 18' is a quarter of a wavelength at the centre frequency of the working band, and the diameter equals half a wavelength.

In the arrangement shown in FIG. 5 a single ferrite disc 20 is mounted on a conductive pedestal 21 which is itself integral with a transformer plate 22. Matching for circulators by using transformer plates is well known and will not be described further here. The pedestal and the transformer plate form an electrically conductive element connecting the ferrite disc to the circulator wall. The ferrite disc carries a dielectric disc 23 and the axial length of the discs 20 and 23 taken together is a quarter of a wavelength at the centre frequency of the circulator for propagation in these discs.

A typical circulator of this type employs yttrium iron garnet as the ferrite at a flux density of about 0.0600 $Wb/m^2$. For a centre frequency of about 2.9 GHz, the thickness of the dielectric disc 23, the ferrite disc 20, the pedestal 21 and transformer plate 22 are 4.21 mm, 2.14 mm, 12.6 mm and 11.7 mm, respectively, the first three of these items having a radius of about 30 mm and the latter having a radius of 77 mm.

These dimensions are given for a dielectric discs with a dielectric constant of 15 but may have to be modified slightly for use with brush beryllium or alumina discs when the dielectric constant is about 9.

A similar arrangement to that of FIG. 5 but using two ferrite discs 24 and 25, two dielectric discs 26 and 27, two conductive pedestals 28 and 29, and two transformer plates 30 and 31 is shown in FIG. 6.

An example of another form for the ferrite, dielectric pedestal and transformer plate is shown in FIG. 7, and this triangular type of arrangement can be used in circulators such as that shown in FIG. 1 to replace the generally cylindrical arrangements previously specifically mentioned. A ferrite layer 33, a dielectric layer 34, a conductive pedestal 35 and a conductive transformer plate 36 are all in the shape of equilateral triangles. Either one or two assemblies such as are shown in FIG. 7 may be used.

Although certain embodiments of the invention have been specifically described and illustrated it will be realised that the invention may be put into practice in many other ways. For example instead of dielectric and ferrite discs, a ferrite post may be used with a dielectric collar, the combined post and collar having a diameter equal to half a wavelength for propagation, in the composite post and collar, at the said frequency. A single ferrite member and a single dielectric member as a collar may be used for example with one end but not the other of the ferrite member in contact with the circulator walls and the overall length of the members equal to a quarter wavelength at the said centre frequency. Instead two ferrite posts each with a dielectric collar may be used, the overall length being a quarter of a wavelength at the said centre frequency. The dielectric material need not have the same dielectric constant as the ferrite provided this constant is in the range 3 to 150.

FIG. 8 gives an indication of the utility of the present invention. The vertical axis represents the useful band of the circulator, that is the difference between the split frequencies $\omega_{+1}$ and $\omega_{-1}$ divided by the centre band $\omega_0$. The horizontal axis represents the thickness ($L_F$) of each of the ferrite disc 15' and 16' in FIG. 3 divided by the total thickness ($L_T$) of each composite disc. The letter K is a magnetic parameter indicating the strength of the magnetic field applied to the ferrite discs. FIG. 9 indicates for example that even with the strongest magnetic field, that is $K = 0.6$ a removal of two thirds of the ferrite material only halves the bandwidth. However, this change results in a factor of nine increase in average power rating. Several present day requirements for 10% circulators (that is circulators in which the bandwidth is 10% of the centre frequency) cannot be met using three port circulators, and four port differential phase shift circulators which are typically four to five times more bulky and three to four times more expensive have to be used. These requirements can be met by a three port circulator according to the invention.

I claim:

1. A three-port microwave junction circulator for use with a waveguide, including a junction member defining three ports, a gyromagnetic element within the junction member and having one surface only in electrical contact therewith, means for applying a magnetic field to traverse the gyromagnetic element in a predetermined direction, and at least one dielectric element aligned with the gyromagnetic element in the said direction, the overall dimension in the said direction of the gyromagnetic and dielectric elements taken together being substantially equal to an odd number of quarters of a wavelength, for propagation in the gyromagnetic and dielectric elements, at the centre frequency of a working range of frequencies of the circulator.

2. A circulator according to claim 1 including a further gyromagnetic element within the junction member, aligned with other gyromagnetic element in the said direction and having one surface only in electrical contact with the junction member, and at least one further dielectric element aligned with the said further gyromagnetic element in the said direction, the overall dimension in the said direction of the said further elements taken together being substantially equal to either a quarter of a wavelenth or an odd number of quarters of a wavelength, for propagation in the said further elements, at the said centre frequency.

3. A circulator according to claim 1 wherein the gyromagnetic element is positioned in a region of the junction member where the magnetic field is, in operation, substantially a maximum, the three ports have centres in a plane generally transverse to the said direction, with imaginary lines from the said centres to the point of intersection of the plane and the axis of the magnetic field, in operation, within the junction member, forming three equal angles in the plane.

4. A circulator according to claim 3 wherein the junction member has parallel conductive walls normal to the said direction, and the circulator includes at least one electrically conductive element positioned between the gyromagnetic element and one of the conductive walls, and in electrical contact with the said wall, the gyromagnetic element being mounted with that surface thereof which is in electrical contact with the junction member abutting the electrically conductive element.

5. A circulator according to claim 3 wherein the gyromagnetic and dielectric elements are triangular in cross-section in planes parallel to the said plane, and the axes of the gyromagnetic and dielectric elements normal to the said planes pass substantially through the said point of intersection.

6. A three-port microwave junction circulator for use with a waveguide, including a cylindrical gyromagnetic element, a junction member containing the gyromagnetic element and defining three ports, each port having its centre in a plane generally transverse to the axis of the gyromagnetic element, with imaginary lines from the point of intersection of the axis of the gyromagnetic element and the said plane forming three equal angles in the plane, one end surface only of the gyromagnetic element being in electrical contact with the junction member, means for applying a magnetic field to the gyromagnetic element in the axis direction, and a cylindrical dielectric element associated with and coaxial with the gyromagnetic element, the overall axial length of the gyromagnetic and dielectric members taken together being substantially equal to one quarter of a wavelength for propagation in the gyromagnetic and dielectric elements, at the centre frequency of a working range of frequencies of the circulator.

7. A circulator according to claim 6 wherein the diameter of the gyromagnetic element and the dielectric element is substantially equal to half a wavelength for propagation in the said elements at the centre frequency of the said working range.

8. A circulator according to claim 7 including a further cylindrical gyromagnetic element within the junction member, axially aligned with the other gyromagnetic element and having one end surface only in electrical contact with the junction member, and a further cylindrical dielectric element associated with and coaxial with the said further gyromagnetic element, the axial length of the said further elements taken together being substantially equal to one quarter of a wavelength, for propagation in the said further elements, at the said centre frequency.

9. A circulator according to claim 8 wherein the gyromagnetic elements are ferrite discs.

10. A circulator according to claim 9 wherein the dielectric elements are disc shaped and each is mounted with one of its plane surfaces in contact with one of the plane surfaces of a different ferrite disc, each dielectric disc having the same diameter as that of the ferrite disc to which it is mounted.

11. A circulator according to claim 9 wherein the junction member has parallel conductive walls normal to the axis of the ferrite discs, and the circulator includes at least two electrically conductive cylindrical elements each associated with a different ferrite disc, each conductive element being positioned between the associated ferrite disc and one of the conductive walls, and in electrical contact with the said one wall, each ferrite disc being mounted with that end surface thereof which is in electrical contact with the junction member abutting one end surface of its associated conductive member.

12. A circulator according to claim 9 wherein the dielectric elements are at least partially hollow and each contains the associated gyromagnetic element, and it is the overall diameters of the gyromagnetic and the dielectric elements, and of the further gyromagnetic and further dielectric elements, which are each substantially equal to the said half wavelength.

13. A circulator according to claim 7 wherein the gyromagnetic element is a ferrite disc.

14. A circulator according to claim 13 wherein the dielectric element is disc shaped with the same diameter as the ferrite disc and is mounted with one of its plane surfaces in contact with one of the plane surfaces of the ferrite disc.

15. A circulator according to claim 14 wherein the junction member has parallel conductive walls normal to the axis of the ferrite disc, and the circulator includes at least one electrically conductive cylindrical element positioned between the ferrite disc and one of the conductive walls, and in electrical contact with the said wall, the ferrite disc being mounted with that end surface thereof which is in electrical contact with the junction member abutting one end surface of the electrically conductive member.

16. A circulator according to claim 13 wherein the dielectric element is at least partially hollow and contains the gyromagnetic element, and it is the overall diameter of the gyromagnetic and dielectric elements, which is substantially equal to the said half wavelength.

* * * * *